US006594974B2

(12) United States Patent
Theriault

(10) Patent No.: US 6,594,974 B2
(45) Date of Patent: Jul. 22, 2003

(54) DEVICE FOR PACKAGING SHEET-LIKE FOLDED PACKAGES

(76) Inventor: Dominic Theriault, 19 Dupuis, Saint-Jacques QBC (CA), J0K 2R0

( * ) Notice: Subject to any disclaimer, the term of this patent is extended or adjusted under 35 U.S.C. 154(b) by 48 days.

(21) Appl. No.: 09/946,672

(22) Filed: Sep. 6, 2001

(65) Prior Publication Data

US 2003/0041570 A1 Mar. 6, 2003

(51) Int. Cl.[7] ..... B65B 5/08
(52) U.S. Cl. ..... 53/500; 53/501; 53/251
(58) Field of Search ..... 53/58, 500, 542, 53/501, 251

(56) References Cited

U.S. PATENT DOCUMENTS 3,374,902 A * 3/1968 Mills ..... 414/789.1
3,720,040 A * 3/1973 Rocker ..... 53/500
3,854,270 A 12/1974 Cloud et al.
3,995,540 A * 12/1976 Huiskes ..... 414/790.3
4,264,255 A * 4/1981 Saro et al. ..... 414/788.3
4,332,124 A 6/1982 Jaton
4,474,521 A * 10/1984 Jaton ..... 414/788.3
4,514,964 A 5/1985 Langen
4,656,815 A 4/1987 Jaton
4,902,184 A * 2/1990 Fritz ..... 414/790.3
5,233,814 A 8/1993 Bergerioux et al.
5,354,170 A 10/1994 Schweingruber et al.
5,560,184 A 10/1996 Tisma
5,575,464 A 11/1996 Martinez et al.

* cited by examiner

*Primary Examiner*—Scott A. Smith
*Assistant Examiner*—Nathaniel Chukwurah

(57) ABSTRACT

A device for packaging sheet-like folded packages in an overlapping shingled relationship from a delivery conveyor into boxes having an opening without changing the direction of the flow of packages. The device includes a frame, a feeder and a packer mounted on the frame for receiving the packages from the delivery conveyor at a receiving end thereof and for selectively receiving and carrying boxes therein, respectively. The feeder includes a first conveyor for conveying packages through the feeder in the package flow direction and a detector for detecting each package entering the feeder. The packer includes a second conveyor for conveying downwardly the boxes adjacent to the feeder in a box direction generally transverse relative to the package flow direction to stack up and fill in the boxes by successively falling therein after passing through the box openings in the package flow direction.

20 Claims, 4 Drawing Sheets

DEVICE FOR PACKAGING SHEET-LIKE FOLDED PACKAGES

FIELD OF THE INVENTION

The present invention is directed to a device for packaging sheet-like folded packages into boxes and more particularly to a device for packaging sheet-like folded packages in an overlapping shingled relationship from a delivery conveyor into boxes without changing the direction of the flow of the packages.

BACKGROUND OF THE INVENTION

A device for filling a container a flat folded box blanks has had several embodiments. U.S. Pat. No. 4,656,815 issued to Jaton on Apr. 14, 1987 discloses a method and device for filling folded blanks into a container via special device which removes blanks one at a time from a flow of shingled blanks and inserts these blanks on their edge in a row or stack in the container. The insertion of these blanks in the container is performed with the blanks rotated 90 degrees from their original sliding position relative to each other when they come out of the folder-gluer machine. This device is very complex and might become unproductive.

U.S. Pat. No. 4,332,124 also issued to Jaton on Jun. 1, 1982 discloses a device for packaging folded boxes, the flow of which is converted into a stack-like flow. This device is also very complicated and has several drawbacks regarding changing of the traveling direction of the box flow which causes difficulties in the flow monitoring, and the possible need for manual assistance in helping boxes in their traveling.

OBJECTS OF THE INVENTION

It is therefore an object of the present invention to provide an improved device for packaging sheet-like folded packages that generally obviates the above mentioned disadvantages.

Another object of the present invention is to provide a device for packaging sheet-like folded packages that uses the gravity to make the successive sheet-like folded packages to fall in boxes with a continuous flow.

Also another object of the present invention is to provide a device for packaging sheet-like folded packages that works without changing direction of a flow of the packages.

A further object of the present invention is to provide a device for packaging sheet-like folded packages that increases packaging productivity.

Still another object of the present invention is to provide a device for packaging sheet-like folded packages in a simple way without any manual assistance.

Still a further object of the present invention is to provide a device for packaging sheet-like folded packages that is easy to assemble and adapt to different delivery conveyors and relatively inexpensive to manufacture.

Other objects and advantages of the present invention will become apparent from a careful reading of the detailed description provided herein, within appropriate reference to the accompanying drawings.

SUMMARY OF THE INVENTION

According to the present invention, there is provided a device for packaging sheet-like folded packages coming out in an overlapping shingled relationship from a delivery conveyor into boxes without changing a direction of a flow of the packages, each of said boxes defining a box opening, said device comprises: a frame; a feeder mounted on the frame for receiving said packages from said delivery conveyor at a receiving end thereof, said feeder including a first conveyor for conveying said packages from said receiving end to a feeding end, said feeding end being downstream from said receiving end in said package flow direction; and a packer mounted on the frame for selectively receiving and carrying said boxes therealong, said packer including a second conveyor for conveying generally downwardly said boxes adjacent said feeding end of said feeder in a box direction generally transverse relative to said package flow direction so as to allow said packages to stack up into said boxes by successively falling therein by gravity after passing through said box openings generally in said package flow direction.

Typically, the feeder includes a package detector for detecting each one of said packages entering said feeder and a stopper for selectively blocking the packages from entering said feeder, said device including a controller connected to said detector for counting said packages detected by said detector, said controller controlling said second conveyor for filling in said boxes with said detected packages and selectively activating said stopper upon detection of a predetermined quantity of said packages entering said feeder.

Typically, the frame includes a guiding support slidably securing said feeder thereto, whereby said feeder is adjustably positioned relative to said packer depending on size of said boxes filled with said packages, said guiding support having a lock for locking position of said feeder relative to said frame.

In one embodiment, the packer includes a box detector connected to said controller for detecting said boxes being in position to be filled in with said detected packages, whereby said controller releases said stopper upon detection of one of said boxes by said box detector.

Typically, the first conveyor is a lower belt connected to a first motor for receiving and conveying said packages thereon, said feeder including an upper conveyor located above and substantially parallel to said lower belt for driving said detected packages therebetween, said upper conveyor being substantially vertically and slidably mounted on said feeder transverse relative to said package flow direction, a compressing guide substantially vertically and slidably mounted on said receiving end of said feeder transverse relative to said package flow direction for compressing and guiding said flow of packages from said delivery conveyor down into said feeder, and a second package detector connected to said controller and located at said feeding end of said feeder for detecting each one of said packages entering said boxes, whereby said controller controls said second conveyor from detection of said packages by said second package detector and counting said packages therewith.

Typically, the upper conveyor includes an upper belt connected to a second motor and located in proximity of said feeding end of said feeder.

In one embodiment, the compressing guide includes a receiving portion extending upwardly and transversely away from said feeder relative to said package flow direction.

Typically, the compressing guide includes an abutment plate and said stopper including a pneumatic piston for abutting said abutment plate and clamping said packages therebetween, thereby stopping the packages from entering said receiving end of said feeder.

In one embodiment, the upper conveyor includes a pneumatic cylinder adjustably and vertically positioning said upper conveyor relative to said lower belt.

Typically, the second conveyor includes a guiding chute having a box retainer and connected to a driving member said box retainer for retaining said boxes from falling under gravity, said driving member connecting to said controller, whereby downward displacement of said boxes is controlled adjacent said feeding end of said feeder.

Typically, the guiding chute includes a back support for slidably supporting said boxes thereon, two lateral belts parallel and adjustably positioned relative to each other for abutting external opposite sides of one of said boxes, said box retainer being a pneumatic cylinder pushing on one of said lateral belts toward the other of said lateral belts for applying pressure on said one box and clamping said one box between said lateral belts, said driving member including two motors, each motor being connected to corresponding one of said lateral belts for activation thereof.

Typically, the back support is longitudinally and slidably mounted on said frame in the box direction for receiving different lengths of said boxes thereon, and said lateral belts being slidably mounted on said frame generally transverse relative to the box direction and to the package flow direction for receiving different widths of said boxes therebetween.

Typically, the device further includes a discharger for receiving said boxes filled with said detected packages from said packer and discharging the filled boxes away from said device, said discharger mounting on said frame.

In one embodiment, the discharger includes a discharge conveyor having a first end below said packer for receiving said filled boxes coming out therefrom and for discharging said filled boxes away from said device, and a retaining guide for retaining a free end of said filled boxes getting off from said back support of said packer and for guiding said filled boxes on said first end of said discharge conveyor.

Typically, the retaining guide includes a bar having a first end pivotally connected to said frame about a horizontal pivot axis transverse to said package flow direction, a second end for abutting said boxes, and a biasing means for biasing said second end of said bar against said boxes.

Typically, the second end of said bar has a roller freely pivotally mounted thereon parallel to said pivot axis, said biasing means being a pneumatic cylinder providing a constant pressure on said roller of said second end to radially abut said boxes.

In one embodiment, the discharger has a box detector connected to said controller for detecting discharge of said boxes from said first end of said discharge conveyor, whereby said controller confirms discharge of said filled boxes from said device.

In one embodiment, the controller includes a user interface for allowing a user to select a quantity of said detected packages to fill in each one of said boxes.

In one embodiment, the controller includes a user interface for allowing a user to select a constant pressure to be maintained into said pneumatic cylinder of said second conveyor of said packer.

Typically, the back support includes two elongated bars parallel to each other and independently, slidebly mounted on said frame generally transverse relative to the box direction and to the package flow direction for supporting different widths of said boxes thereon.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
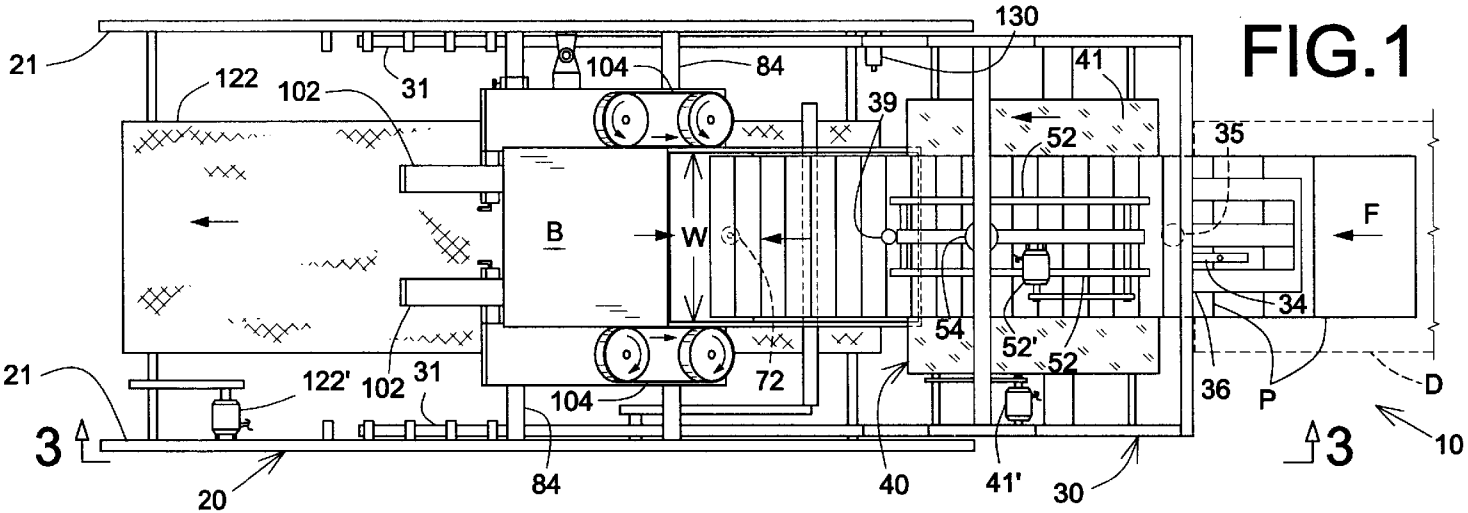
FIG. 1 is a top view of an embodiment of a packaging device according to the present invention, showing the folded packages directly coming form a delivery conveyor in an overlapping shingled relationship.
Figure 2:
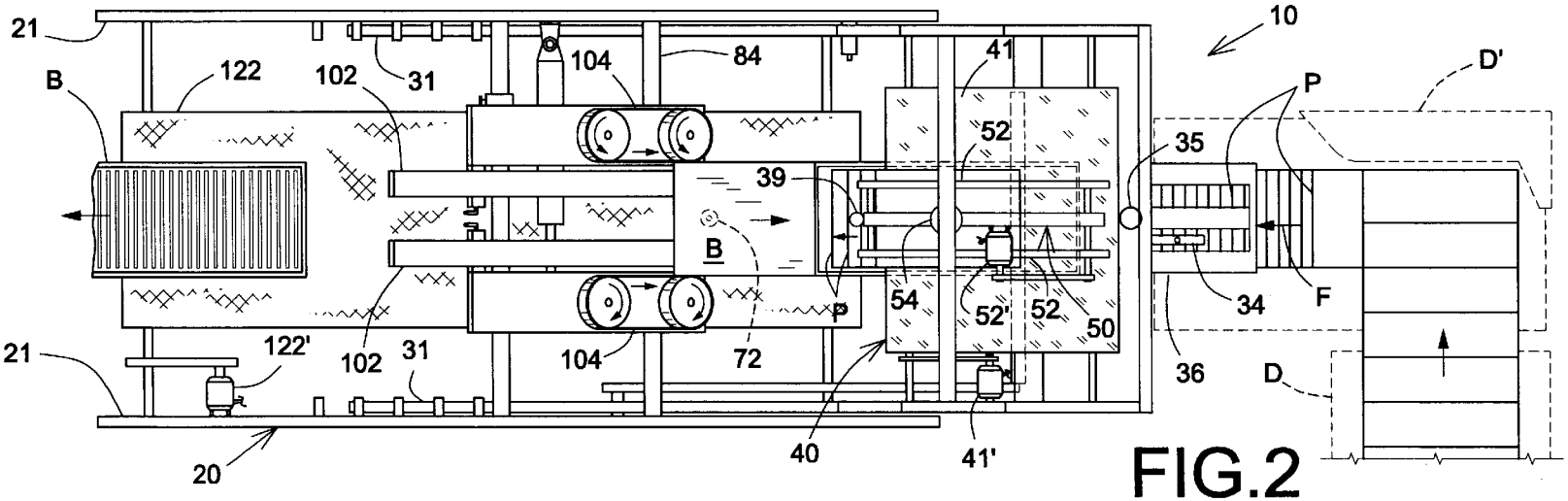
FIG. 2 is a view similar to FIG. 1; showing a stopped flow of packages with last few packages entering a filled box and a 90-degree conveyor interposed between the delivery conveyor and the embodiment of FIG. 1.
Figure 3:
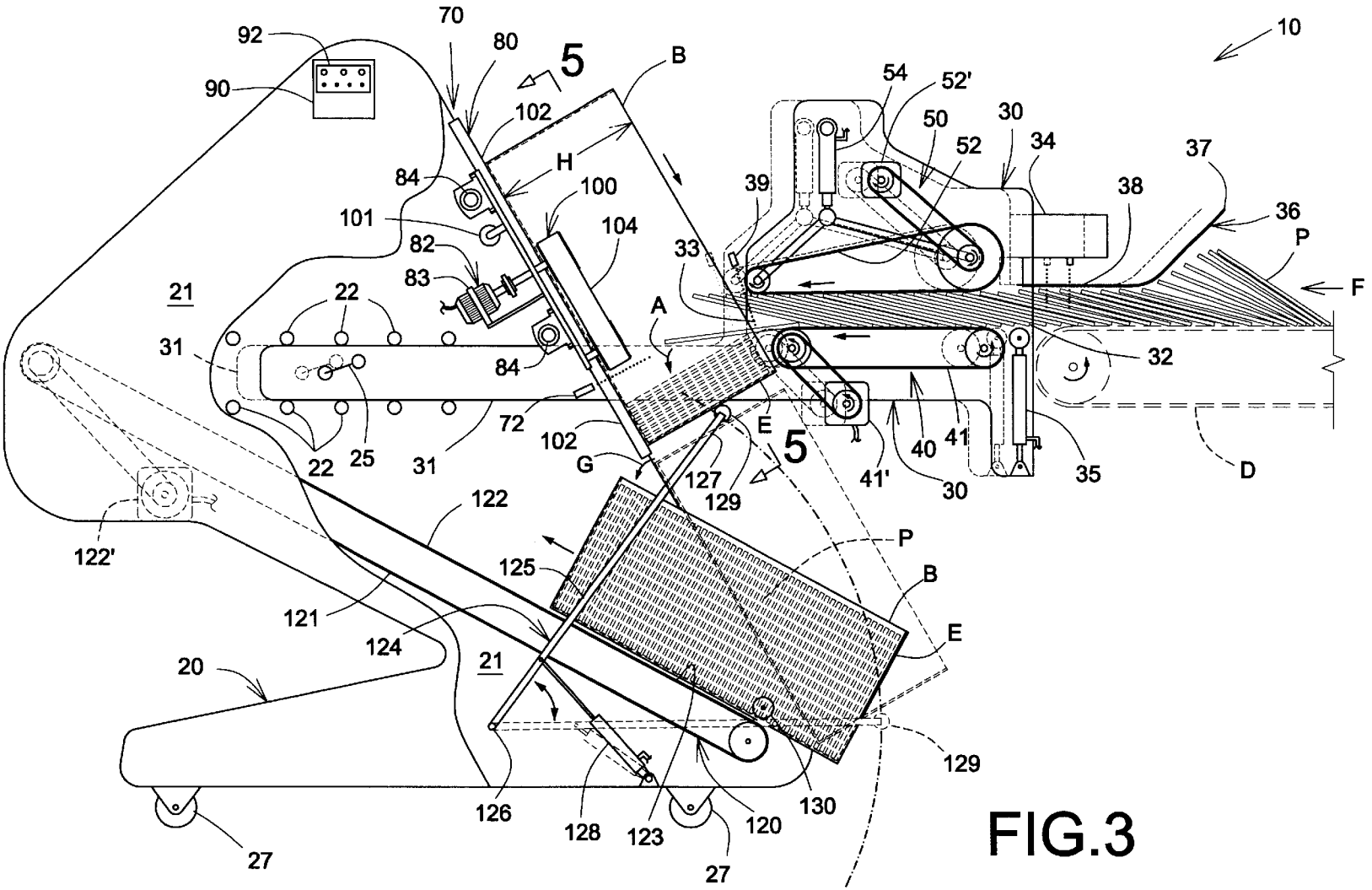
FIG. 3 is a side view taken along line 3—3 of FIG. 1.

FIGS. 1 and 2 show an embodiment 10 of a device for packaging sheet-like folded packages P in an overlapping shingled relationship coming from a delivery conveyor D of a folder-gluer machine (not shown) or the like, or a 90-degree conveyor D1, into opened boxes B without changing the direction of the flow F of the packages P. Each box B defines a box opening to receive the packages P therethrough. FIGS. 1, 3 and 5 refer to the beginning of the packaging process of the box B while FIGS. 2 and 4 refer to the completion of the packaging process of the box B with a different width W for illustration purposes.

Figure 4:
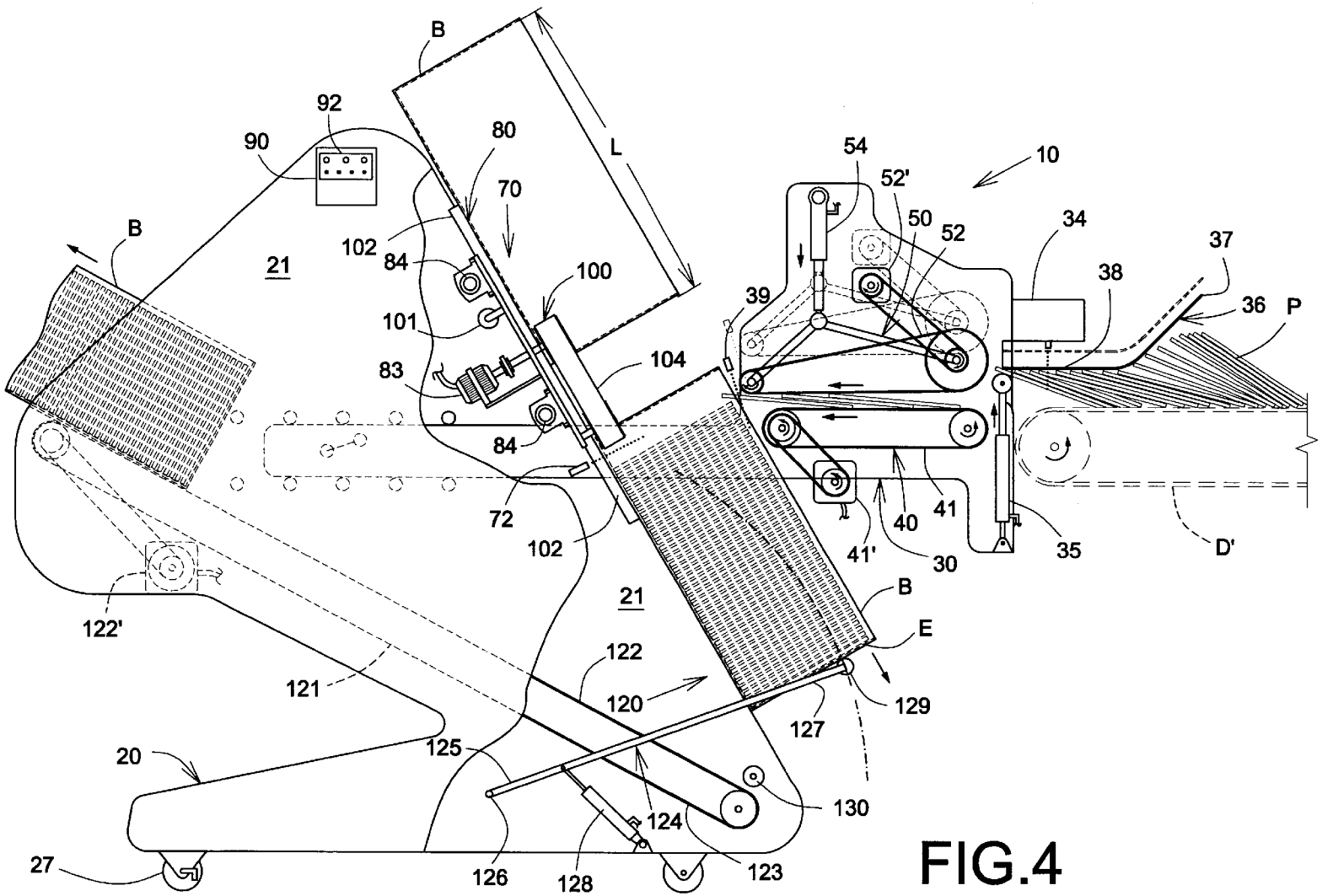
FIG. 4 is a side view taken along line 4—4 of FIG. 2.
Figure 5:
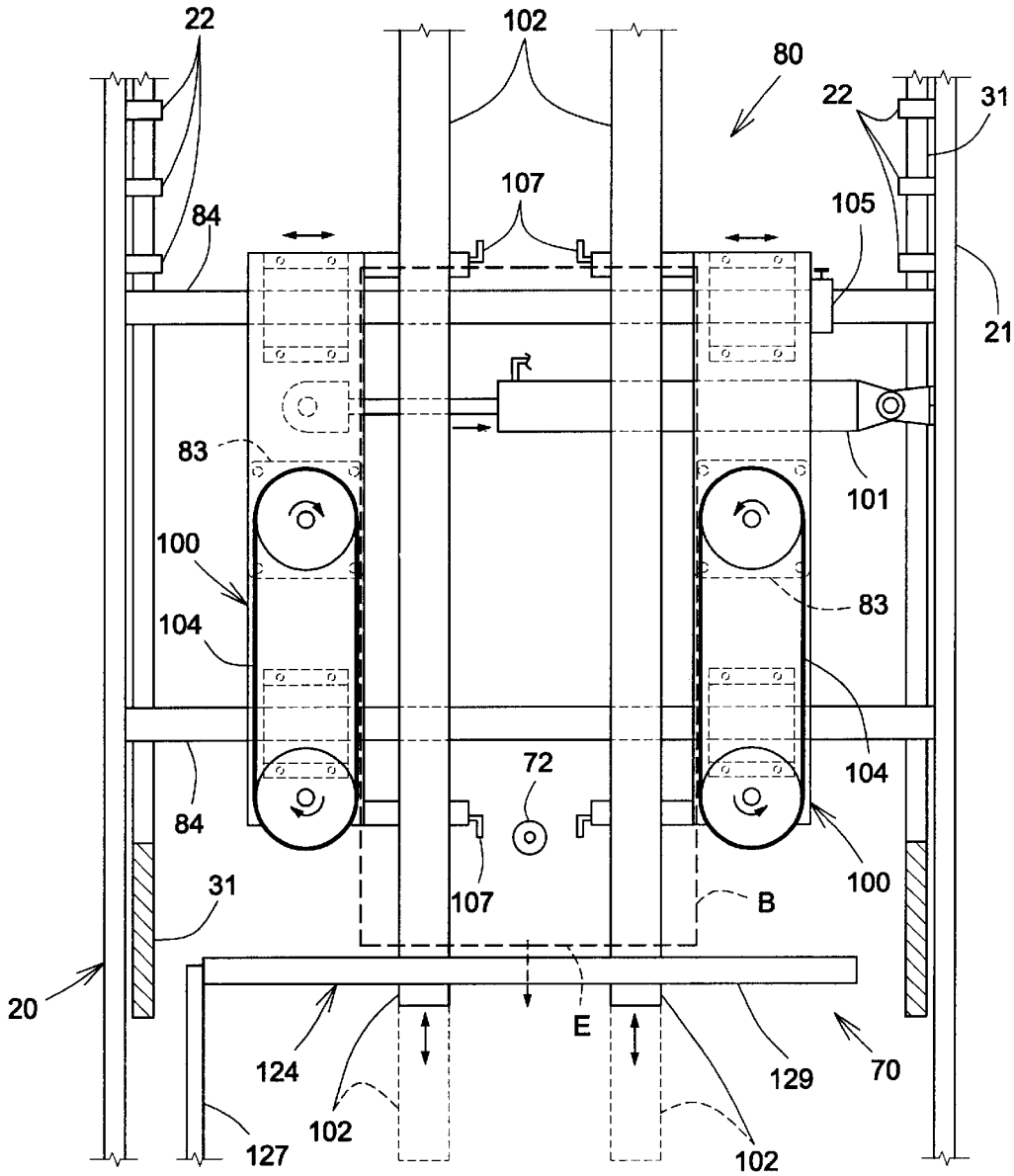
FIG. 5 is an enlarged partial view taken along line 5—5 of FIG. 3; showing the packer of the embodiment of FIG. 1 with the box in dashed lines.

Referring to FIGS. 3 and 4, the device 10 includes a frame 20, preferably two lateral parallel plates 21 secured together apart from each other, a feeder 30 mounted on the frame 20 for receiving the packages P from the delivery conveyor D at a receiving end 32 thereof, a packer 70 also mounted on the frame 20 to carry the boxes B there along and located adjacent to a feeding end 33 of the feeder 30 for the packages P to enter the boxes B by falling therein by gravity after passing through the box opening, and a discharger 120 that receives the boxes filled in with packages from the packer 70 and discharges them away from the device 10.

The feeder 30 includes a lower conveyor 40, preferably a lower belt 41 connected to a motor 41', for conveying the packages P from the receiving end 32 to the feeding end 33 in a continuation of the direction of the flow F of packages P, a detector 34, preferably optical, for detecting each one of the packages P entering the feeder 30, and a stopper 35 for intermittently blocking the packages P from entering the feeder 30. The lower conveyor 40 is generally horizontal but could have any inclination angle varying between plus and minus forty-five (±45) degrees from horizontal, as long as the packages P can properly, successively and freely fall in the boxes B under gravity.

As illustrated in dotted lines in FIG. 3, the feeder 30 is preferably horizontally slidably mounted on the frame 20 via guiding support 22, preferably made out of a plurality of aligned roller bearings on each lateral plate 21, engaged by protruding arms 31 of the feeder 30 in order to properly position the latter relative to the packer 70 depending on the height H of the boxes B. When in proper position, the feeder 30 is locked in place via a locking device 25.

The feeder 30 also includes an upper conveyor 50 preferably having an upper belt 52 connected to a second motor 52' located above and substantially parallel to the lower belt 41 such that the detected packages P are flowing and guided between the two. The upper conveyor 50 is preferably vertically adjustable relative to the lower belt 41 (transverse to the flow F of the packages P) in order to adjust to different sizes of packages P (as shown by the dotted lines of FIG. 4). Accordingly, the upper conveyor 50 is mounted to the feeder 30 via a pneumatic cylinder 54, the latter also providing a constant preselected pressure of the upper belt 52 on the packages P. Preferably, the upper conveyor 50 is located toward the feeding end 33 of the feeder 30 to ensure a proper positioning of the packages P just before entering the boxes B, and could also include one or more narrow belts parallel to each other since they basically serve as upper guide.

A rigid compressing guide 36 is substantially vertically and slidably mounted on the receiving end 32 of the feeder 30, transverse to the direction of the flow F, to compress, thin and direct the incoming flow F of packages P from the delivery conveyor D down into the feeder 30, using a preferably manual adjustment device (not shown) or the like. Preferably, the rigid guide 36 includes a receiving portion 37 extending upwardly away from the feeder 30 opposite to (or against) the direction of the flow F. The guide 36 also includes a substantially horizontal abutment plate 38. The stopper 35, preferably a pneumatic piston, intermittently abuts the abutment plate 36 and clamps the packages P there between (see FIG. 4), to intermittently stop the packages P from entering the receiving end 32 of said feeder 30.

A second package detector 39, also preferably optical, is located at the feeding end 33 of the feeder 30 to detect each one of the packages P entering the boxes B in the packer 70.

As shown in FIGS. 3 to 5, the packer 70 includes a conveyor 80 to convey downwardly the boxes B adjacent the feeding end 33 of the feeder 30 in a box direction (along their length L) generally transverse relative to the package flow direction to allow for the packages P to stack up and fill in the boxes B by successively falling therein (as indicated by arrow A in FIG. 3). The conveyor 80 can have any inclination angle from the vertical down to approximately sixty (60) degrees, preferably approximately thirty (30) degrees, as long as the boxes B remain on the conveyor 80 and the packages P properly stack therein under gravity.

Referring to FIG. 5 the second conveyor 80 includes a guiding chute 100 with a box retainer 101 to prevent the boxes B from falling down under gravity and is connected to a driving member 82, preferably electrical motors 83.

The guiding chute 100 includes a back support, preferably made out of two elongated parallel bars 102 that slidably support the boxes B thereon, and two lateral belts 104 parallel and adjustably positioned relative to each other along transverse rods 84 to adjust to the width W of the boxes B (see FIGS. 1 and 5). The two lateral belts 104 are adapted to abut external opposite sides of boxes B and are driven by a respective motor 83. One of the belt 104 is secured relative to the chute 100 using a clamp 105 while the other one 104 is biased toward the first one 104 via the box retainer 101, preferably a pneumatic cylinder 106 to apply pressure on the box B and compress it between the two lateral belts 104, with preferably controlled constant pressure.

Preferably, each elongated support bar 102 is secured to a respective lateral belt 104 to jointly move along the rods 84 to support different width W of the boxes B. The bars 102 are longitudinally and slidably mounted on the frame 20 in the box direction, preferably via chute 100 of the packer 70, depending on the length L of different boxes B thereon, as to support the boxes B until they are completely filled in with packages P and before they successively enter the discharger 120. Once the bars 102 are properly longitudinally positioned, they are secured in place using securing devices such as clamping screws 107 or the like.

As illustrated in FIGS. 3 to 5, the packer 70 includes a box detector 72 so located to detect the conveying boxes B entering the packer 70 at the proper location for the beginning of the packaging process.

The discharger 120 includes (see FIGS. 3 and 4) a discharge conveyor 121, preferably a belt 122 connected to a motor 122', with a first end 123 located below the packer 70 to receive the filled boxes B coming out from the packer 70 thereon and discharge the boxes B away from the device 10, and a retaining guide 124 to retain a free end E of the filled boxes B getting off from the bars 102 of the packer 70 and to guide the filled boxes B such that they properly pivot and fall on the first end 123 of the discharge conveyor 121, as illustrated by arrow G of FIG. 3.

The retaining guide 124 includes a bar 125 that has a first end 126 pivotally connected to one of the plates 21 of the frame 20 about a horizontal pivot axis transverse to the flow F of packages P, and a second end 127 to abut the free end E of the boxes B, and a biasing means, preferably an additional pneumatic cylinder 128, to bias that second end 127 against the boxes B and provide a constant pressure for the retaining of the boxes B by second end 127. The second end 127 of the bar 125 has a roller 129 freely pivotally mounted thereon about an axis parallel to the pivot axis of the first end 126 to radially abut the boxes B. Obviously, after one box B has left the retaining guide 124, the latter has its roller 129 automatically biased against the next coming box B by the cylinder 128.

The discharger 120 has a box detector 130, also preferably optical, that detects boxes B falling on the discharge conveyor 121 and the discharge of the same B from the first end 123 of the discharge conveyor 121 and also from the device 10.

The frame 20 preferably includes caster wheels 27, preferably lockable, to facilitate the displacement of the device 10 and its proper positioning relative to the delivery conveyor D.

Although all adjustments of the device 10 could be manually performed by an operator, the device 10 preferably includes a controller 90 to control them and have the device 10 self-operating. In order to provide the controller 90 with all parameters required by the different components such as operating pressure of the different pneumatic devices 35, 54, 101, 128, speed of the different motors 41', 52', 83', 122', etc., a controller user interface 92 is mounted on the frame 20 at a location accessible by a control operator.

In the present invention, the package detectors 34, 39, the box detectors 72, 129, the pneumatic piston 35 and cylinders 54, 101, 128, and the motors 83' are preferably connected to the controller 90.

Accordingly, at the beginning of the operating cycle, as illustrated in FIGS. 1 and 3, the sheet-like folded packages P are supplied by the delivery conveyor D in an overlapping shingled relationship with a flow F. The feeder 30 of the device 10 is positioned relative to the conveyor D and receives the flow F of the packages P without changing its direction.

The packages P are directed by the lower conveyor 40 of the feeder 30 and loaded into boxes B conveying on the packer 70 without any change in the direction of the flow F of the packages P.

The thickness of the flow F is regulated and generally compressed by adjusting the upper conveyor 50 and the position of the compressing guide 36 relative to the lower belt 41 at the receiving end 33 of the feeder 30, and by the constant pressure applied by the upper belt 52 and its pneumatic cylinder 54 at the feeding end 33 of the feeder 30, as shown in FIG. 4 by the dotted lines. The flow F is then smoothly directed from the receiving end 32 to the feeding end 33 for the packages P to gradually fill in the box B.

Before starting the packaging process, the operator has provided the controller 90 with the required quantity of packages P to be stacked in each one of the boxes B, through the user interface 92. The controller 90 automatically counts the packages P entering the feeder 30 via the package detector 34. The packages P that are actually being loaded into the box B at the feeding end 33 of the feeder 30 are detected again by the second package detector 39 and counted by the controller 90. From the inputs of these detectors 34, 39, mainly the second one 39, the controller 90 controls the continuous displacement (or feeding) of the box B being filled in onto the chute via the motors 83' driving the lateral belts 104.

When the required quantity of the packages P are loaded in the box B, the controller 90 activates the piston of the stopper 35 for the latter to abut the abutment plate 38 of the guide 36 to stop the flow F of packages P from entering the feeder 30, as shown in FIG. 4, until a next box B is in proper position ready to be filled in, which is relatively short (approximately between one (1) and ten (10) seconds) in time relative to the filling of a box B. The filled box B is then moved onto the discharger 120 as detailed herebelow. Once the box detector 72 indicates to the controller 90 that the filled box B had left the packer 70, the controller 90 rapidly activates the lateral belts 104 and the retaining cylinder 101 until the detector 72 detects the presence of the next following box B in proper position. At this time, the controller 90 retracts the piston 35 to allow for the stopped packages P to enter into the feeder 30 and resume the packaging process.

The box B that is being filled in with detected packages P in the packer 70 slowly exits the chute 100 and the support bars 102 while having its free end E constantly retained by the roller 129 of the retaining guide 124 of the discharger 120. When the bars 102 stop supporting the box B, the latter is forced to pivot around the roller 129 and fall by gravity on the first end 123 of the discharge conveyor 121, as illustrated by arrow G of FIG. 3. At this moment, the box B is detected by the detector 130 and carried away from the device 10 by the belt 122. As soon as the detector 130 sees that the box B has left the first end 123 of the conveyor 121, the controller 90 is notified that the box B normally exited the device 10 and the discharger 120 is ready to receive the next coming filled box B.

The operator provides inputs to the controller 90 such as the quantity of packages P entering a same box B, the step increment of displacement of the box B on the chute 80 of the packer 70 for each package P entering the box B (translated in number of rotations of the motors 83' connected to the lateral belts 104), the constant pressures to be maintained in all different pneumatic cylinders 54, 101 and 128, and the pressure to apply to the piston 35 in order to stop the flow F of packages P. The horizontal positioning of the feeder 30 relative to the packer 70, the vertical adjustment of the guide 36, the speed adjustment of the motors 41', 52' driving the respective belt 41, 52, and the lateral positioning of the first lateral belt 104 on the transverse rods 84 are all preferably performed by the operator before the start of the packaging operation using the device 10. Obviously, all pneumatic devices are independently connected to a pneumatic system (not shown) via control devices (not shown) connected to the controller 90, as well known in the art.

The device 10 continues to package sheet-like folded packages P into boxes B without any manual intervention of the operator, except for the feed of the empty boxes B into the packer 70, which could ultimately be automated, as it would be obvious to one skilled in the art. Furthermore, the controller 90 of the device 10 is preferably connected to the folder-gluer machine or the like in order to be able to ultimately stop it by cutting its supplied power in case of malfunctioning and/or possible problem occurring during the packaging process.

Although the present device for packaging sheet-like folded packages has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A device for packaging sheet-like folded packages coming out in an overlapping shingled relationship from a delivery conveyor into boxes without changing a direction of a flow of said packages, each of said boxes defining a box opening, said device comprising:

a frame;

a feeder mounted on the frame for receiving said packages from said delivery conveyor at a receiving end thereof, said feeder including a first conveyor for conveying said packages from said receiving end to a feeding end, said feeding end being downstream from said receiving end in said package flow direction; and a packer mounted on the frame for selectively receiving and carrying said boxes therealong, said packer including a second conveyor for conveying generally downwardly said boxes adjacent said feeding end of said feeder in a box direction generally transverse relative to said package flow direction so as to allow said packages to stack up into said boxes by successively falling therein by gravity after passing through said box openings generally in said package flow direction.

2. The device of claim 1, wherein said feeder includes a package detector for detecting each one of said packages entering said feeder and a stopper for selectively blocking the packages from entering said feeder, said device including a controller connected to said detector for counting said packages detected by said detector, said controller controlling said second conveyor for filling in said boxes with said detected packages and selectively activating said stopper upon detection of a predetermined quantity of said packages entering said feeder.

3. The device of claim 2, wherein said frame includes a guiding support slidably securing said feeder thereto, whereby said feeder is adjustably positioned relative to said packer depending on size of said boxes filled with said packages, said guiding support having a lock for looking position of said feeder relative to said frame.

4. The device of claim 2, wherein said packer includes a box detector connected to said controller for detecting said boxes being in position to be filled in with said detected packages, whereby said controller releases said stopper upon detection of one of said boxes by said box detector.

5. The device of claim 2, wherein said first conveyor is a lower belt connected to a first motor for receiving and conveying said packages thereon; said feeder including an upper conveyor located above and substantially parallel to said lower belt for driving said detected packages therebetween, said upper conveyor being substantially vertically and slidably mounted on said feeder transverse relative to said package flow direction, a compressing guide substantially vertically and slidably mounted on said receiving end of said feeder transverse relative to said package flow direction for compressing and guiding said flow of packages from said delivery conveyor down into said feeder, and a second package detector connected to said controller and located at said feeding end of said feeder for detecting each one of said packages entering said boxes, whereby said controller controls said second conveyor from detection of said packages by said second package detector and counting said packages therewith.

6. The device of claim 5, wherein said upper conveyor includes an upper belt connected to a second motor and located in proximity of said feeding end of said feeder.

7. The device of claim 5, wherein said compressing guide includes a receiving portion extending upwardly and transversely away from said feeder relative to said package flow direction.

8. The device of claim 5, wherein said upper conveyor includes a pneumatic cylinder adjustably and vertically positioning said upper conveyor relative to said lower belt.

9. The device of claim 5, wherein said compressing guide includes an abutment plate and said stopper including a pneumatic piston for abutting said abutment plate and clamping said packages therebetween, thereby stopping the packages from entering said receiving end of said feeder.

10. The device of claim 2, wherein said second conveyor includes a guiding chute having a box retainer and connected to a driving member, said box retainer for retaining said boxes from falling under gravity, said driving member connecting to said controller, whereby downward displacement of said boxes is controlled adjacent said feeding end of said feeder.

11. The device of claim 10, wherein said guiding chute includes a back support for slidably supporting said boxes thereon, two lateral belts parallel and adjustably positioned relative to each other for abutting external opposite sides of one of said boxes, said box retainer being a pneumatic cylinder pushing on one of said lateral belts toward the other of said lateral belts for applying pressure on said one box and clamping said one box between said lateral belts, said driving member including two motors, each motor being connected to corresponding one of said lateral belts for activation thereof.

12. The device of claim 11, wherein said back support is longitudinally and slidably mounted on said frame in the box direction for receiving different lengths of said boxes thereon, and said lateral belts being slidably mounted on said frame generally transverse relative to the box direction and to the package flow direction for receiving different widths of said boxes therebetween.

13. The device of claim 12, wherein said back support includes two elongated bars parallel to each other and independently, slidably mounted on said frame generally transverse relative to the box direction and to the package flow direction for supporting different widths of said boxes thereon.

14. The device of claim 11, wherein said controller includes a user interface for allowing a user to select a constant pressure to be maintained into said pneumatic cylinder of said second conveyor of said packer.

15. The device of claim 2, further including a discharger for receiving said boxes filled with said detected packages from said packer and discharging the filled boxes away from said device, said discharger mounting on said frame.

16. The device of claim 15, wherein said discharger includes a discharge conveyor having a first end below said packer for receiving said filled boxes coming out therefrom and for discharging said filled boxes away from said device, and a retaining guide for retaining a free end of said filled boxes getting off from said back support of said packer and for guiding said filled boxes on said first end of said discharge conveyor.

17. The device of claim 16, wherein said retaining guide includes a bar having a first end pivotally connected to said frame about a horizontal pivot axis transverse to said package flow direction, a second end for abutting said boxes, and a biasing means for biasing said second end of said bar against said boxes.

18. The device of claim 16, wherein said second end of said bar has a roller freely pivotally mounted thereon parallel to said pivot axis, said biasing means being a pneumatic cylinder providing a constant pressure on said roller of said second end to radially abut said boxes.

19. The device of claim 16, wherein said discharger has a box detector connected to said controller for detecting discharge of said boxes from said first end of said discharge conveyor, whereby said controller confirms discharge of said filled boxes from said device.

20. The device of claim 2, wherein said controller includes a user interface for allowing a user to select a quantity of said detected packages to fill in each one of said boxes.

* * * * *